United States Patent [19]

McCullough, Jr.

[11] Patent Number: 4,977,654

[45] Date of Patent: Dec. 18, 1990

[54] PROCESS AND APPARATUS FOR CRIMPING FIBERS

[75] Inventor: Francis P. McCullough, Jr., Lake Jackson, Tex.

[73] Assignee: The Dow Chemical Company, Midland, Mich.

[21] Appl. No.: 340,099

[22] Filed: Apr. 18, 1989

[51] Int. Cl.[5] ..... D02G 1/00; D02G 1/04; D02J 1/00

[52] U.S. Cl. ..... 28/278; 28/279; 28/280; 28/247; 28/249; 19/66.1; 19/66.2

[58] Field of Search ..... 28/278, 279, 280, 247, 28/249; 19/66.1, 66.2; 223/30, 31, 32

[56] References Cited

U.S. PATENT DOCUMENTS

| | | | |
|---|---|---|---|
| 642,769 | 2/1900 | Wessel | 28/279 |
| 951,863 | 3/1910 | Wessel | 19/66.2 |
| 1,168,171 | 1/1916 | Crumbaugh | 28/279 |
| 1,904,030 | 4/1933 | Post | 223/32 |
| 1,918,284 | 7/1933 | Mitchell | 223/30 |
| 2,245,874 | 6/1941 | Robinson . | |
| 2,508,489 | 5/1950 | Browne et al. | 19/66.2 |
| 2,623,266 | 12/1952 | Hemmi . | |
| 2,668,564 | 2/1954 | Lasos | 28/279 |
| 2,696,034 | 12/1954 | Swartz | 28/280 |
| 3,348,283 | 4/1967 | Stanley | 28/249 |
| 3,348,993 | 9/1967 | Sissors | 28/247 |
| 3,765,818 | 9/1973 | Migazaki | 28/279 |

FOREIGN PATENT DOCUMENTS

| | | | |
|---|---|---|---|
| 661613 | 3/1965 | Belgium | 28/279 |
| 4533377 | 11/1967 | Japan | 28/279 |

*Primary Examiner*—Werner H. Schroeder
*Assistant Examiner*—Bibhu Mohanty

[57] ABSTRACT

An apparatus for crimping and permanently heat setting a fiber or tow without non-uniform stress or tension, comprising a conveying means having a multiplicity of openings, means for supplying the fiber or tow across the conveying means, means for inserting the fiber or tow into the openings of the conveying means whereby the fiber is retained in a non-linear shape in the openings without stress or tension, and a heating or irradiation zone through which the conveying means and fiber or tow pass.

16 Claims, 2 Drawing Sheets

FIG. 1
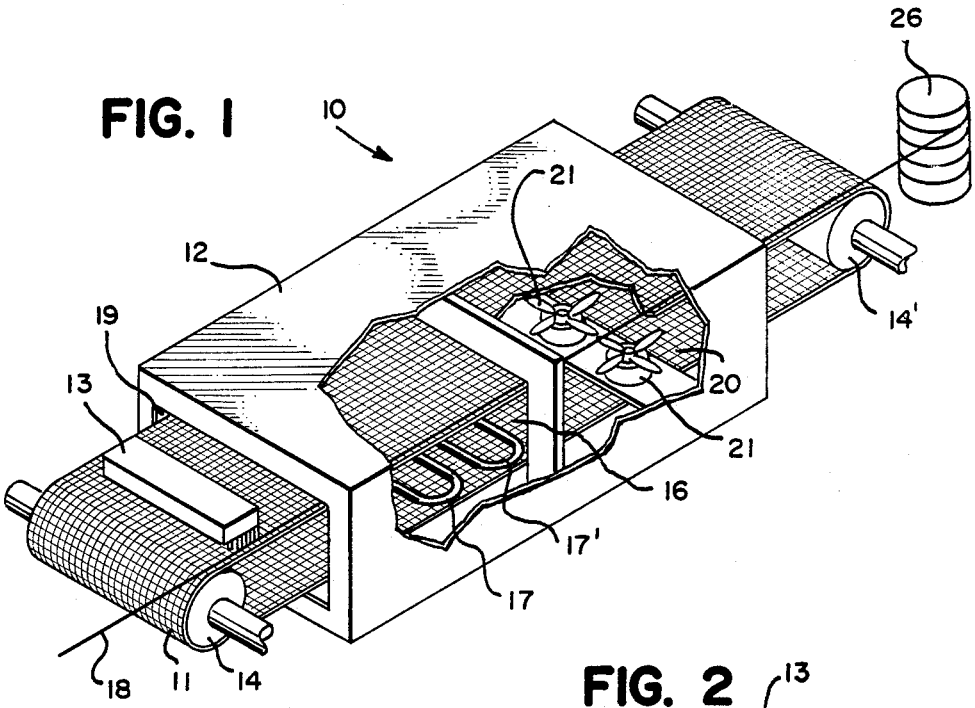
FIG. 2
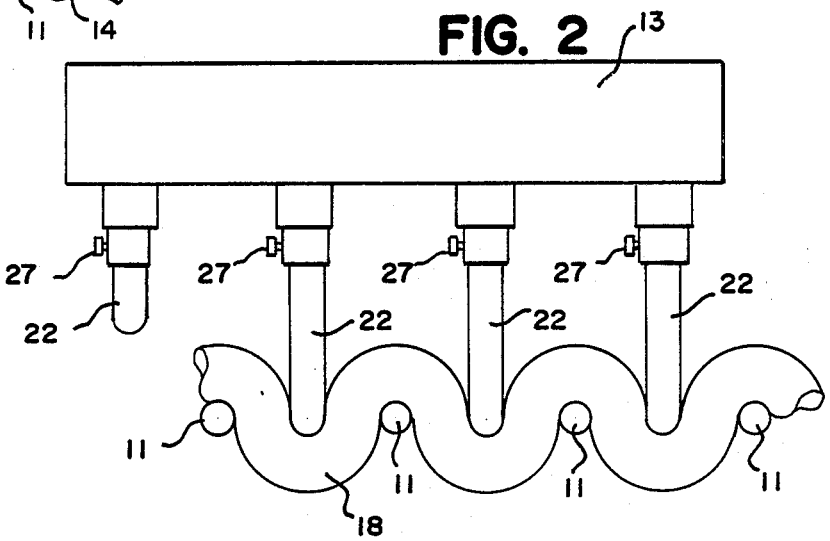
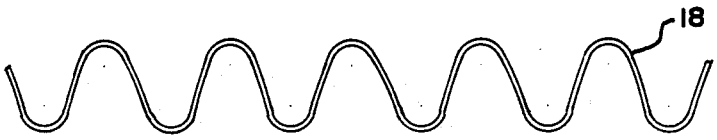
FIG. 3

PROCESS AND APPARATUS FOR CRIMPING FIBERS

FIELD OF THE INVENTION

The present invention relates to an apparatus and method for providing fibers with non-stressed crimps. More particularly, the invention relates to a method and apparatus for providing a loop or sinusoidal configuration to inorganic or polymeric fibers by heat treating or irradiating without subjecting the fibers to stress or tension either before or during crimping. The apparatus is especially useful to produce crimped fiber from large sized tows. The crimped fibers formed by the present invention when dyed possess good dye uniformity.

BACKGROUND OF THE INVENTION

Crimp can be defined as the non-linearity in fiber. For most of the man-made fibers employed in carpet manufacture, the crimp or bend in the fiber is induced by thermal/mechanical techniques. It can also be thought of as the difference between the non-linear (crimped) fiber and the straightened fiber (fiber extended). Crimp is important in carpet fibers because it provides bulk to the yarn by preventing two fibers from laying parallel to one another. As a result, the carpet tuft will have greater covering power, appear softer, and give better resistance to wear and abrasion, among other benefits.

Crimp is also useful in the processing of staple fibers. Crimp is particularly useful in the processing of high modulus fibers which are difficult to work with because of slipperiness.

The crimp for most carpet fibers is placed in the fibers using a stuffer box method is rarely uniform. The stuffer box technique produces fibers having a wavy, random zig-zag type crimp which is balanced. The randomness of the crimp which is obtained would seem to cause the fiber to appear to have a nonuniform crimp; however, if several fibers are viewed simultaneously, it can be seen that the crimp produced by this method is regularly irregular.

Crimp in the stuffer box is achieved by passing yarn(s) or tow(s) into a uniformly heated chamber which is at the temperature required to heat set the fibers in their crimped or non-linear configuration. As the yarns are forced into the chamber by feed rolls, it pushes against yarn which is already in the chamber, thereby causing the filaments to bend and buckle (crimp).

A weighted tube fitted into the top of the stuffer box governs the flow and quantity of yarn into the stuffer box. The frequency (crimps per inch) and the crimp amplitude of the fibers are controlled by regulating the speed of the feed rolls to that of the take up rolls as well as the weight of the tube. Crimp setting by these techniques can be done for single filaments or on multiple ends (tow) using the spunize technique. The crimps are generally characterized by numerous sharp bends.

In order to obtain crimp the fiber must undergo bending. During bending two types of stress modes are developed simultaneously. There is a tensile stress along the outer curvature of the fiber, while a compressive stress is acting on the inner portion of the bend.

A recent study of the affects of crimp on polyester fiber demonstrated that severe bending (example, V-type crimp) can result in extensive fiber damage. Even the rounded V-type fibers showed compression ridges on the underside of the crimp, while severely crimped fibers (V-type bends) had reduced mechanical properties due to compressive forces operating within the fiber. The result is a weaker fiber. It has also been found that such overcrimped fibers tend to take up dye preferentially on the underside of the bend and can be the cause for optical streaking in the resulting yarn. This comes about because the knee of the bend projects toward the surface of the yarn and hence are more visible to the eye. Since they will contain more dye the affect is a dark optically appearing streak. At the same time, because the dye tends to concentrate at these points, the remaining fiber tends to be deficient in dye and appear lighter.

It has been shown that crimp permanency after loading can differ between fiber producers and even among various types (e.g., bright and semidull) made by the same producer. Since some tension on fibers and yarn inevitably attends normal fiber processing it is to be expected that some loss in crimp definition will likely occur. This loss must be near identical from spindle to spindle, twister to twister, etc. otherwise the yarns will appear to be different since crimped fibers differ in appearance from uncrimped fibers as a result of the reduced-bulking factor. At the same time some fiber elongation is obtained during crimp removal which would tend to order the fiber microstructure. This could influence dyeing since a more ordered microstructure will take up dye differentially than fibers which have not undergone any elongation.

U.S. patent application Ser. No. 112,353 of McCullough et al, which is herein incorporated by reference, discloses one method for preparing novel non-linear carbonaceous fibers having physical characteristics resulting from heat treating stabilized polymeric fibers in the form of a fabric. There is described a process wherein the fabric is substantially irreversible heat set under conditions free of non-uniform stress and tension. In order to obtain fibers which are non-linear, it is necessary to deknit the fibers. Knitting and then deknitting the fabric to obtain non-linear carbonaceous fibers increases the cost in producing the fibers.

U.S. Pat. No. 2,245,874 to Robinson, discloses a method for forming curled fiber material by passing fibers over rollers under conditions to bend and stretch the fibers beyond elastic limits. Such a process cannot be used to produce the non-linear fibers of the invention.

U.S. Pat. No. 2,623,266 to Hemmi discloses the mechanical preparation of sinusoid or spiraloid crimped fibers. The fibers are heated and passed through a series of bars which impart a meander-like crimp. However, the fibers are formed in a crimped and stretched state.

It is desirable to provide a relatively inexpensive and simple method for producing non-linear fibers and tows.

It is further desirable to provide a method for producing non-linear fibers which does not require the prior formation of a fabric.

It is also desirable to prepare non-linear carbonaceous fibers without performing a knit-deknit operation.

SUMMARY OF THE INVENTION

The present invention is directed to a method and an apparatus for crimping and permanently heat setting ceramic or polymeric fibers without non-uniform stress or tension. The apparatus comprises a conveying means having a plurality of openings in which the tow or fiber is inserted. A means for supplying the fiber or tow across the conveying means is provided. The fiber or tow within the conveying means is transported through one or more heating zones. The heating zone may comprise one or more heating units. One heating unit may comprise a fiber oxidation or stabilization zone. Another heating unit may comprise a means for substantially irreversibly heat setting the fiber in an inert atmosphere.

In operation, the fiber or tow is inserted into the openings of the conveyor and continuously conveyed in a non-linear manner without stress or tension through at least one heating zone. The fiber or tow is passed through the heating zone at a temperature and rate to heat set and/or carbonize the fiber or tow. The tows may comprise fibers of about 40 to 320K.

The fibers or tows utilized with the apparatus of the invention may comprise any inorganic or polymeric material capable of being heat set. Preferably, the polymeric fibers are the high performance fibers such as oxidized acrylic fiber (OPF), aramids, PBI, etc. The apparatus is particularly suited to prepare the carbonaceous fibers disclosed in said application Ser. No. 112,353.

In its broadest aspects, the invention also provides a process for crimping and heat setting a fiber (filament) or tow of filaments without stress or tension comprising the steps of supplying a fiber or tow across an apertured conveying means, inserting said fiber or tow into the apertures of said conveying means so that the fiber or tow is maintained in a non-linear configuration substantially free of non-uniform stress or tension within said aperatures, passing said non-linear fiber or tow through a heating zone at least at a temperature which physically effects said fiber or tow, and then cooling said fiber or tow while in a non-linear configuration.

It is therefore an object of the invention to provide an apparatus and a process which can prepare non-linear carbonaceous fibers without a knit/deknit operational step.

It is a further object of the invention to provide a crimped fiber having improved dyeability characteristics.

Other objects and a fuller understanding of the invention will be had by referring to the following description and claims of a preferred embodiment, taken in conjunction with the accompanying drawings, wherein like reference characters refer to similar parts throughout the several views.

BRIEF DESCRIPTION OF THE DRAWINGS

FIG. 1 is a perspective view, partly in section disclosing a crimping apparatus of the invention;

FIG. 2 is an elevational view showing a section of the crimping unit of FIG. 1;

FIG. 3 illustrates a uniformly crimped fiber prepared by the apparatus of the invention;

DESCRIPTION OF THE PREFERRED EMBODIMENTS OF THE INVENTION

Figure 4:
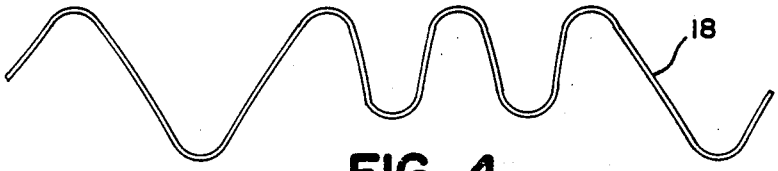
FIG. 4 illustrates a non-uniformly crimped fiber prepared by the apparatus of the invention.

Although specific terms are used in the following description for the sake of clarity, these terms are intended to refer only to the particular structure of the invention selected for illustration in the drawings, and are not intended to define or limit the scope of the invention.

As seen in FIG. 1, the apparatus of the invention 10 comprises an apertured endless conveying belt 11 which travels around drive rolls 14, 14' through a closure 12. The closure 12 may comprise one or more compartments for heating and/or cooling. For example, there is provided a heating chamber 16 with heaters 17, 17' through which a fiber or tow 18 passes and is cooled in chamber 20 with cooling fans 21. The fiber or tow 18 is first passed through a crimper 13 wherein the fiber or tow 18 is inserted into the apertures of the conveying belt 11. After passage through the closure 12 the fiber or tow 18 is taken up on take-up roll 26. In operation the fiber or tow 18 is placed in the apertures of the conveyor belt 11 so as to be in an unstressed state and without tension during heat setting.

As seen in FIG. 2, the crimper 13 comprises reciprocating fingers 22 whose heights are made adjustable with adjusting means 27. By the adjustment of the fingers 22, the depth of the fiber or tow 18 can be adjusted so as to control the configuration of the fiber or tow 18 which is heat set by the depth of the fiber or tow in the apertures. As seen in FIG. 3, a fiber 18 is shown wherein the fiber 18 is in a uniform sinusoidal configuration as a result of uniform length fingers 22.

FIG. 4 illustrates the fiber 18 wherein the fingers 22 are of a non-uniform length.

Figure 5:
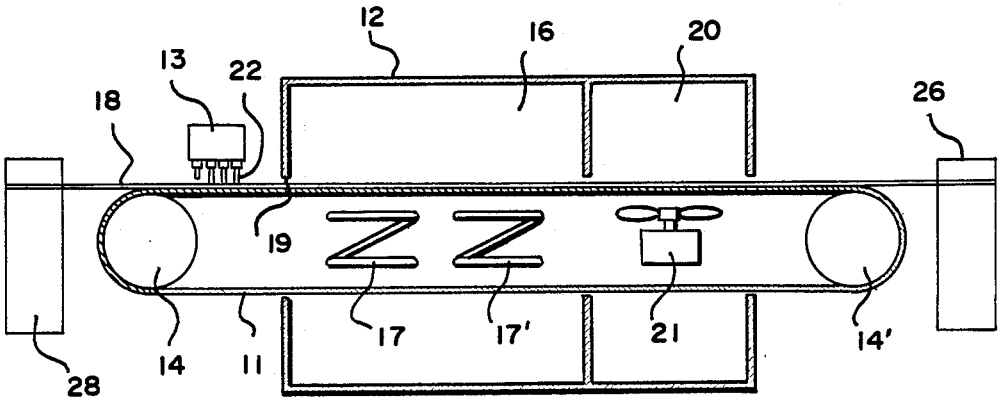
FIG. 5 is a side elevation of the apparatus.

In FIG. 5, the operation of the apparatus is more clearly shown. Fiber or tow 18 is delivered from a supply roll 28 on to an apertured conveyor 11. A crimping device 13 with adjustable reciprocating fingers 22 insert the fiber or tow 18 into the apertures of conveyor 11 so that the fiber or tow 18 forms a sinusoidal configuration as shown in FIG. 2. After insertion of the fiber or tow 18 into the apertures, it is passed into a closure 12 without any stress or tension on the tow or fiber maintaining its configuration. Closure 12 may comprise one or more heating chambers 16. Where a pre-oxidized or stabilized fiber or tow 18 is being carbonized, the heating chamber 16 is filled with an inert gas. The carbonization of the fiber or tow 18 may be by means of heaters 17 or by irradiation with a high energy source such as lasers described in any of U.S. Pat. Nos. 4,370,141; 4,364,916; 3,923,950 and 3,767,773, which are herein incorporated by reference.

The fiber or tow 18 which is heat set in chamber 16 in a non-linear configuration is then cooled in chamber 20 by cooling means 21 and carried out of the enclosure to be taken up on roll 26. The conveyor 11 and rolls 26, 28 are synchronized so that the fiber or tow placed on the conveyor 11 is not placed under stress or tension in the heating chamber 16.

Figure 6:
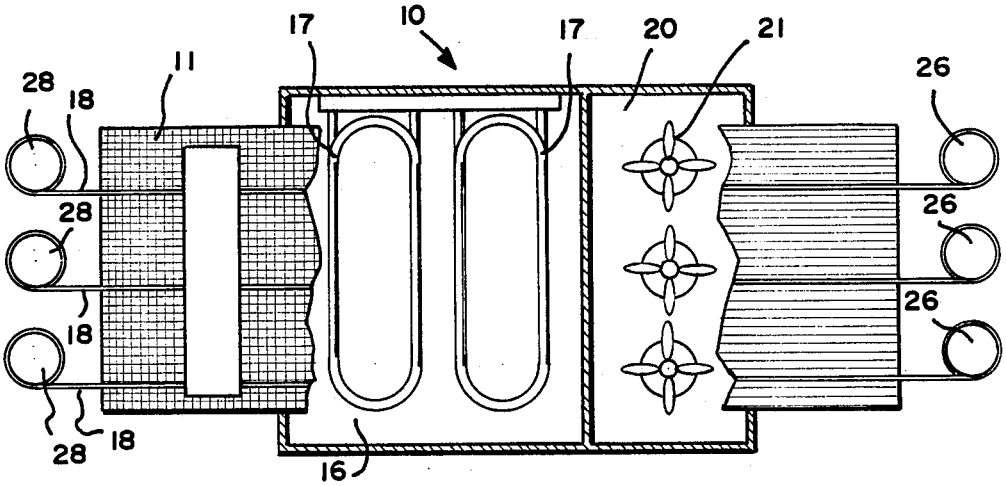
FIG. 6 is a top elevation in section of the apparatus.

FIG. 6 illustrates an apparatus wherein a plurality of fibers or tows 18 are processed by the apparatus 10 utilizing a plurality of supply rolls 28 and take-up rolls 26.

In the case where the fiber or tow comprises stabilized or oxidized polyacrylonitrile fibers and heat setting is to be effected, the oxidized fibers are heated to temperatures of 300° to 1400° C. in a non-oxidizing atmosphere such as nitrogen, argon, helium or hydrogen. The heating zone may be a single or multigradient furnace comprising a number of heating zones. The inert gases can be supplied through the opening 19 of the heating zone or may be injected at various points along the way of the fiber path.

The fiber residence time in the heating zone is dependent upon the particular fiber utilized, the degree of heat set desired, and the temperature(s) utilized.

Although the invention has been described with a certain degree of particularity, it is understood that the present disclosure has been made only by way of example and that numerous changes in the details of construction and the combination and arrangement of parts may be resorted to without departing from the spirit and scope of the invention.

What is claimed is:

1. A process for crimping and heat setting a filament or tow of filaments without applying non-uniform stress or tension comprising the steps of:

supplying a filament or tow of filaments across an apertured conveying means having a planar surface;

inserting said filament or tow of filament into at least two aperatures of said conveying means so that the filament or tow of filaments is maintained in a non-linear configuration;

thereafter passing said non-linear filament or tow of filaments in said unstressed condition through at least one heating zone at a temperature so as to at least partially permanently set said filament or tow of filaments, and then cooling said filament or tow of filaments while in a non-linear configuration, whereby a non-stressed crimp is obtained.

2. The process of claim 1 wherein said filament or tow of filaments is oxidized and then passed through said heating zone so as to form a carbonaceous filament or tow of filaments.

3. The process of claim 1 wherein two heating zones are provided, one of said heating units having an oxidizing atmosphere, the other of said heating units having an inert atmosphere, and said filament or tow of filaments is passed through said heating unit with an oxidizing atmosphere so as to oxidize said filament or tow of filaments and then passed through said heating unit with an inert atmosphere at a temperature and rate to heat set and make carbonaceous said filament or tow of filaments.

4. An apparatus for crimping and heat setting a filament or tow of filaments without applied stress or tension, comprising an apertured conveying means having a planar surface for conveying said filament or tow of filaments to a heating zone without stress or tension, means for supplying a filament or tow of filaments across said conveying means, at least one heating zone associated with said conveying means for heating said filament or tow of filaments while passing therethrough, and insertion means mounted prior to said heating zone for inserting said filament or tow of filaments into the apertures which retain said filament or tow of filaments in a non-linear shape for passage into said heating zone.

5. The apparatus of claim 4 wherein said insertion means comprises a plurality of reciprocating fingers for inserting said filament or tow of filaments into at least two apertures and which fingers withdraw prior to passage into said heating zone.

6. The apparatus of claim 4 wherein said conveying means comprises a movable grate.

7. The apparatus of claim 4 wherein said fingers are adjustable in length.

8. The apparatus of claim 4 wherein said heating zone comprises a convection heating means.

9. The apparatus of claim 4 wherein said heating zone comprises a plurality of heating units.

10. The apparatus of claim 4 wherein said heating zone comprises a laser means.

11. The apparatus of claim 4 wherein said heating zone comprises a means for carbonizing the crimped polymeric filament or tow of filaments.

12. The apparatus of claim 4 wherein said heating zone includes means for providing an inert gas.

13. The apparatus of claim 4 including a cooling zone.

14. The apparatus of claim 4 comprising a plurality of means for supplying filament or tow of filaments across said conveying means.

15. The apparatus of claim 4 including filament or tow of filaments take-up means.

16. The apparatus of claim 4 wherein said conveying means and said filament or tow of filaments supplying means are synchronized.

* * * * *